US008967224B2

(12) United States Patent
Foley et al.

(10) Patent No.: US 8,967,224 B2
(45) Date of Patent: Mar. 3, 2015

(54) SHADE CONSTRUCTION

(75) Inventors: Patrick Eugene Foley, Winston-Salem, NC (US); Alejandro Martin Rossato, Marietta, GA (US)

(73) Assignee: Newell Window Furnishings, Inc., High Point, NC (US)

( * ) Notice: Subject to any disclaimer, the term of this patent is extended or adjusted under 35 U.S.C. 154(b) by 91 days.

(21) Appl. No.: 12/780,550

(22) Filed: May 14, 2010

(65) Prior Publication Data

US 2010/0288446 A1 Nov. 18, 2010

Related U.S. Application Data

(60) Provisional application No. 61/178,618, filed on May 15, 2009.

(51) Int. Cl.

| | |
|---|---|
| ***A47H 5/00*** | (2006.01) |
| ***E06B 3/48*** | (2006.01) |
| ***E06B 3/94*** | (2006.01) |
| ***E06B 9/06*** | (2006.01) |
| ***E06B 9/262*** | (2006.01) |

(52) U.S. Cl.

CPC ..... *E06B 9/262* (2013.01); *E06B 2009/2627* (2013.01)

USPC ..... 160/84.05; 160/84.01

(58) Field of Classification Search

CPC ..... E06B 9/262; E06B 2009/2622; E06B 2009/2627; B31D 3/0215; B31D 3/02

USPC ..... 160/84.01, 84.03, 84.04, 84.05

See application file for complete search history.

(56) References Cited

U.S. PATENT DOCUMENTS

| | | | | | |
|---|---|---|---|---|---|
| 4,130,351 | A | * | 12/1978 | Luboshez | 359/596 |
| RE30,254 | E | | 4/1980 | Rasmussen | |
| 4,397,346 | A | * | 8/1983 | Chumbley et al. | 160/84.01 |
| 4,603,072 | A | | 7/1986 | Colson | |
| 4,790,591 | A | * | 12/1988 | Miller | 160/370.21 |
| 4,931,342 | A | * | 6/1990 | Tolbert et al. | 428/90 |
| 5,184,659 | A | * | 2/1993 | Alcocer | 160/84.04 |
| 5,205,333 | A | * | 4/1993 | Judkins | 160/84.02 |
| 5,313,999 | A | | 5/1994 | Colson et al. | |
| 6,006,812 | A | * | 12/1999 | Corey | 160/84.05 |
| 6,319,586 | B1 | * | 11/2001 | Colson | 428/116 |

(Continued)

FOREIGN PATENT DOCUMENTS

JP 2002036872 A 2/2002

OTHER PUBLICATIONS

Newell Window Furnishings, Inc., Mexican Application No. MX/a/2010/005430, Office Action, Feb. 26, 2014.

(Continued)

*Primary Examiner* — Katherine Mitchell
*Assistant Examiner* — Jeremy Ramsey
(74) *Attorney, Agent, or Firm* — Dennis J. Williamson; Moore & Van Allen PLLC

(57) ABSTRACT

The window covering and shade panel comprise a head rail that supports a shade panel and that may be mounted to a wall, window frame, door or other architectural feature. A layer of film is used with the panel to provide a barrier to air flow and heat insulation. The film may be clear to allow light to penetrate the panel. The clear film allows the heat energy of the sun to pass through the panel while blocking cold air from entering the room. In one embodiment a polyester clear film is chemically adhered to the panel.

15 Claims, 10 Drawing Sheets

(56) References Cited

U.S. PATENT DOCUMENTS

| | | | | |
|---|---|---|---|---|
| 6,345,486 | B1 * | 2/2002 | Colson et al. | 52/793.1 |
| D456,196 | S | 4/2002 | Colson et al. | |
| 6,416,842 | B1 | 7/2002 | Swiszcz et al. | |
| 6,908,661 | B2 * | 6/2005 | Green et al. | 428/178 |
| 7,059,378 | B2 | 6/2006 | Colson et al. | |
| 2002/0011314 | A1 * | 1/2002 | Voss et al. | 160/84.05 |

OTHER PUBLICATIONS

Newell Window Furnishings, Inc., Canadian Application No. 2,704,509, Office Action, Jun. 21, 2012.

Canadian Intellectual Patent Office, Office Action, Sep. 22, 2011, Canadian Patent Application No. 2,704,509.

* cited by examiner

SHADE CONSTRUCTION

This application claims benefit of priority under 35 U.S.C. §119(e) to the filing date of to U.S. Provisional Application No. 61/178,618 as filed on May 15, 2009, which is incorporated herein by reference in its entirety.

FIELD OF THE INVENTION

The invention relates generally to window coverings and more particularly to an improved insulating window covering and shade panel.

BACKGROUND OF THE INVENTION

Moveable window coverings such as blinds, shades and the like are well known. One type of window covering is a cellular or honeycomb shade. This type of window covering typically comprises a shade panel constructed of woven or non-woven material formed into a plurality of contiguous horizontally extending open cells. Other window coverings comprise Roman shades, roller shades, natural shades and the like. These window coverings comprise a shade panel that extends from a head rail and is raised and lowered using various lift mechanisms.

SUMMARY OF THE INVENTION

The window covering may comprise a head rail that supports a shade panel and that is mounted to a wall, window frame, door or other architectural feature. A layer of film is used with the panel to provide a barrier to air flow and heat insulation. The film may be clear to allow light to penetrate the panel. The film allows the heat energy of the sun to pass through the panel while blocking cold air from passing through the panel. In one embodiment a polyester film is chemically adhered to the panel. The film may comprise a clear film, an energy film or a phase changing film.

DETAILED DESCRIPTION OF EMBODIMENTS OF THE INVENTION

Figure 1:
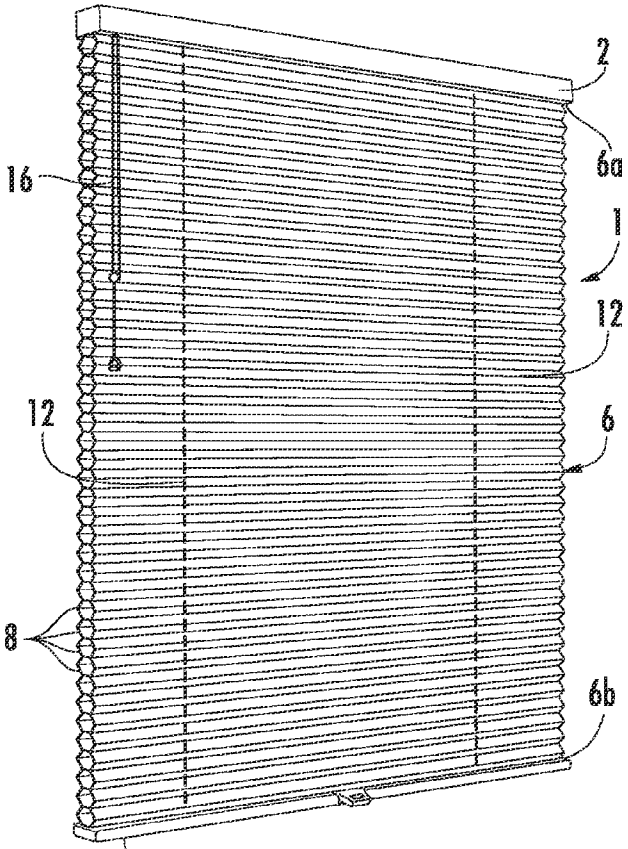
FIG. 1 is a perspective front view of an embodiment of a window covering with an embodiment of the shade panel.

An embodiment of a window covering is shown generally at 1 in FIG. 1 and includes a head rail 2 made of a rigid material such as aluminum, plastic, wood or the like. The head rail 2 is typically mounted to an architectural feature such as a window such that the window covering may selectively cover the feature. While the window covering 1 is typically used with a window, the window covering may be used with other architectural features such as a door, alcove or any other feature. The head rail 2 is typically secured to the architectural feature using releasable brackets such that the window covering may be removably mounted, although any mounting mechanism may be used.

Figure 3:
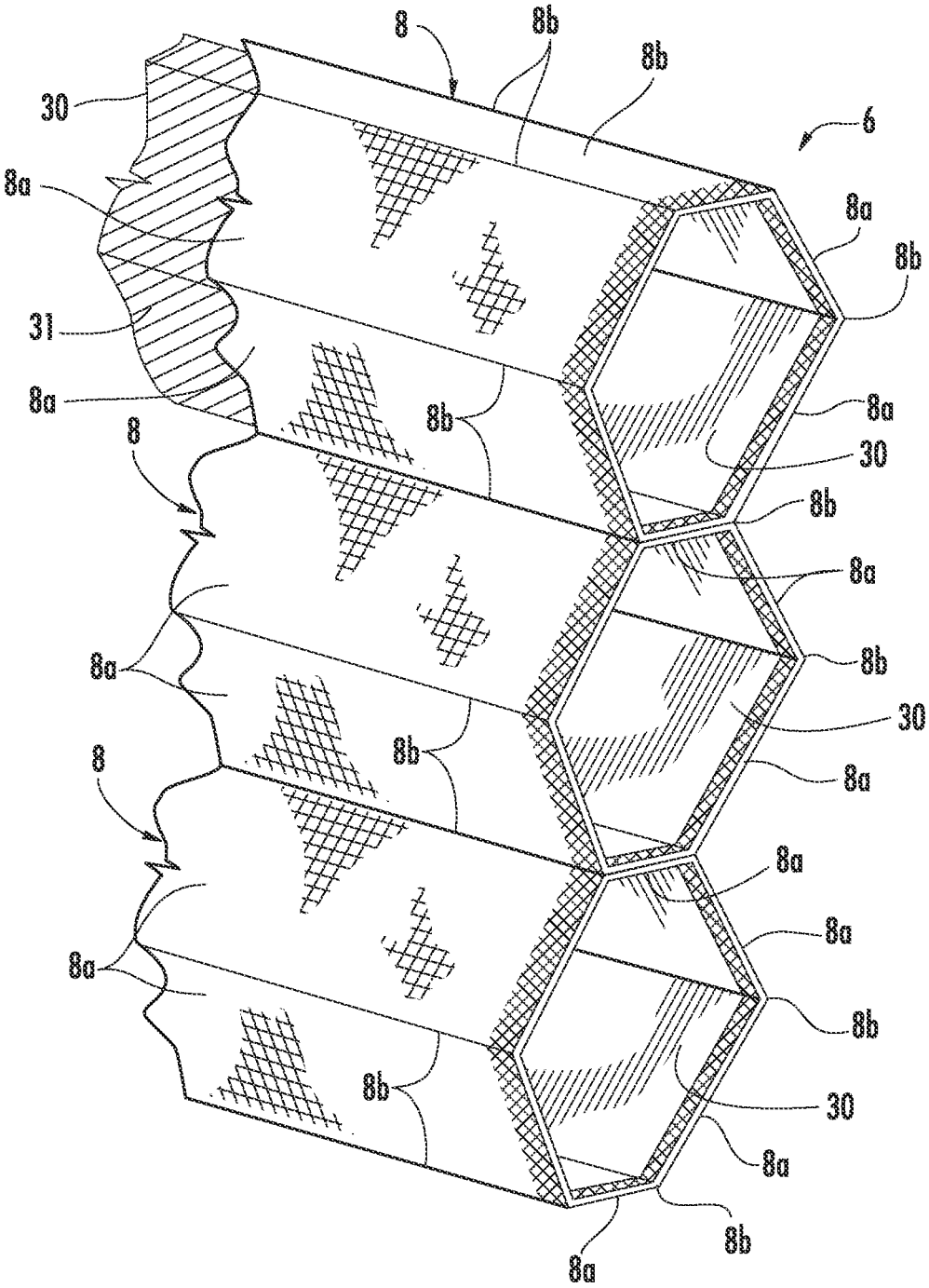
FIG. 3 is a partial perspective view of an embodiment of a shade panel.

Supported on the head rail 2 is a shade panel 6 comprising of a plurality of cells 8 that extend for the width of the panel. The panel 6 has an upper edge 6*a* that is disposed adjacent head rail 2 and a lower edge 6*b*. The panel 6 may be made of a woven or non-woven fabric material that is constructed to form the substantially contiguous cells 8 where the cells have a polygonal cross-sectional shape and extend substantially parallel to the head rail 2. Referring to FIGS. 1 and 3, each cell 8 is formed of a plurality of faces 8*a* that are joined at fold lines 8*b* such that the cell has a generally open interior and can collapse when the shade is retracted and expand when the shade is extended. While cells 8 having six faces are illustrated it is to be understood that the cells may have a fewer or greater number of faces and that the specific shape of the cells may vary. The cellular panel 6 may be created by any known method and is typically made by stitching, gluing, mechanically fastening or otherwise joining multiple pieces of the material together to form the cells. Moreover, while a single cell configuration is illustrated the shade of the invention may be configured as a double or triple cell shade. A double cell configuration has two layers of cells while a triple cell configuration has three layers of cells.

While the panel 6 is described as a cellular shade, the panel may be any type of shade product and may include any type of material that allows light energy to pass through the shade panel including woven or non-woven fabric, textiles, slats, natural fibers such as bamboo or grasses or paper, or the like.

Referring again to FIG. 1, a bottom rail 10 may be secured to the lower edge 6*b* of the panel 6 by adhesive, mechanical connection or other securing device. The bottom rail 10 may be formed of aluminum, wood or other rigid material. The bottom rail 10 adds weight to the panel 6 to assist in the lowering of the panel and maintains the shape of the panel.

The panel 6 is supported on head rail 2 by lift cords 12. The lift cords 12 are connected to the bottom rail 10 and are used to raise and lower the lower edge 6*b* of the panel 6. Typically the lift cords 12 extend through the cells 8 such that the lift cords are hidden from view.

The lift cords 12 extend into the head rail 2 and are connected to draw cords 16 that are manipulated by the user to raise and lower the panel 6. Pulling on draw cord 16 causes lift cords 12 to raise the lower edge of panel 6. Releasing the draw cord 16 allows the lower edge of the panel 6 to extend away from the head rail 2. In some embodiments the lift cords 12 and draw cords 16 comprise a common element such that, for example, each lift cord 12 extends through the head rail to form draw cord 16. The head rail 2 typically includes spools or other mechanisms over which the cords are wound and lock mechanisms for locking the blind panel 6 in the desired position.

Figure 2:
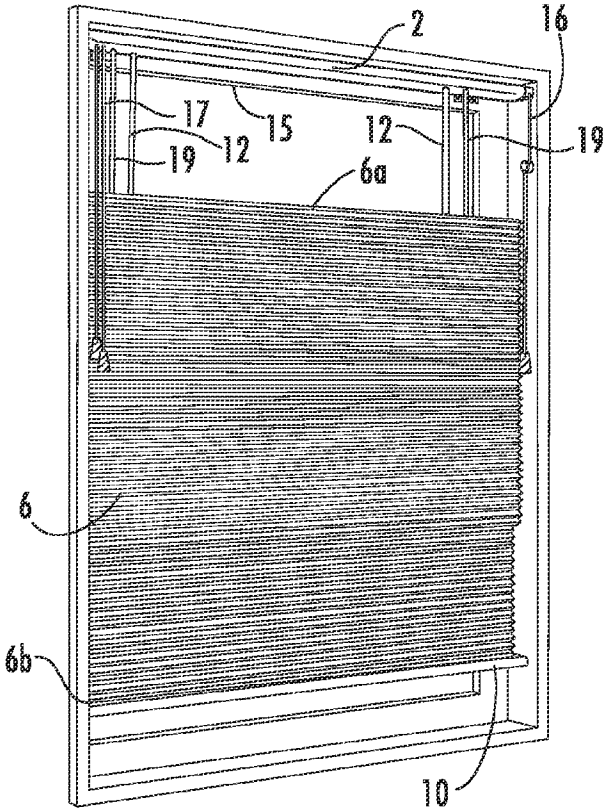
FIG. 2 is a perspective front view of an alternate embodiment of a window covering.

Referring to FIG. 2 a top down shade is shown mounted in window 15 having a similar construction to the window covering shown in FIG. 1 where like reference numerals are used to identify like components previously described with reference to FIG. 1. For a top down shade a second pair of lift cords 19 may be secured to the upper edge 6*a*, or to a top rail located at the upper edge 6*a* of the panel 6, to raise and lower the upper edge 6*a* of the panel 6. For top down shades a second draw cord 17 is connected to lift cords 19 such that pulling and releasing the second draw cord 17 raises and lowers the upper edge 6*a* of panel 6.

The panel 6 may also be raised and lowered using a spring motor connected to the lift cords 12. The spring motor may be located in the head rail 2 or bottom rail 10 and may include a spool connected to each of the lift cords 12 to wind and unwind the lift cords. The spools may be connected to a spring motor such that the spring motor assists in raising the shade panel when a user exerts a force on the shade panel and holds the shade panel in position when the user releases the shade panel. The lift cords 12 may also be raised and lowered by a motor such as an electrical motor that is controlled by the user to both raise and lower the shade panel. The motor may be remotely controlled.

Referring to FIG. 3, located inside of each cell 8 is a layer of film 30 that is used to provide a barrier to air flow. The film may be clear or transparent to allow light to penetrate the panel 6. When the window covering is used on a window the clear film allows the heat and light of the sun to pass through the panel 6 while blocking cold air from the external environment from entering the room through panel 6. The film 30 is applied to the inside surface of each of the faces 8*a* by adhesive 31 such that the entire interior, or substantially the entire interior, of each cell 8 is covered by the film layer.

In one embodiment film 30 is a polyester clear film. The film may comprise polyethylene, polypropylene, nylon or other light permeable film. Moreover, the film 30 does not need to be transparent if visible light passing through the film is not desired. In one embodiment any material that allows radiant light energy to pass through the panel may be used. Allowing radiant light energy to pass through the film allows the heat energy from sunlight to pass through the panel 6 such that solar heat gain from the "greenhouse" effect will warm the room in which the shade panel is used. The film 30 is air impermeable in that it provides a barrier to air flow to prevent conductive heat transfer through the window covering to provide an insulation layer over the window. The film may also include a phase changing film where the film changes color when light hits the film.

Figure 14:
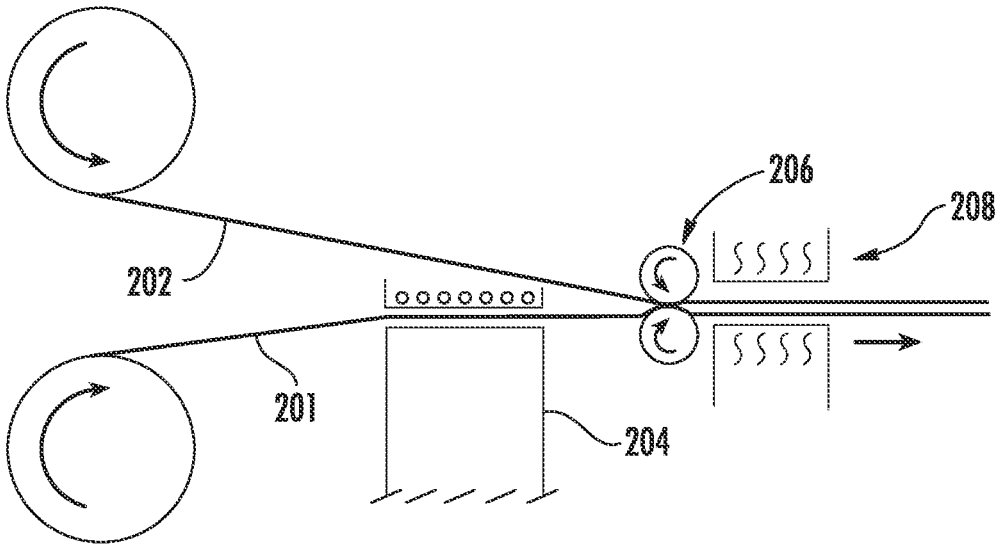
FIG. 14 is a schematic view of a method of making the shade panel.

The film may be attached to the fabric of the panel 6 and the fabric with the film adhered thereto pleated into cellular blankets that are formed into the shade panel. The term fabric as used herein includes woven, non-woven textiles, slats, natural fibers such as bamboo, wood, grasses or paper, synthetic materials such as plastic or the like. Alternatively, the film layer may be inserted during formation of the cells or after the cells are created. The film may also be applied as a liquid directly to the fabric as a coating. In one embodiment a polyester clear film is chemically adhered to the cell fabric as shown in FIG. 14. During this process the film or fabric 201 goes through a bath or print roll 204 that applies liquid adhesive in a thin layer to one side thereof. The film or fabric 201 with the adhesive is brought together with the other layer of film or fabric 202 and pulled through a nip roller 206 and heater 208 to apply pressure and activate the adhesive. Web adhesive may also be used to attach the film to the shade panel. In the web adhesive process adhesive is spun into a thin web and sandwiched between the film and the fabric. The layers of material pass through an oven and nip roller to activate the adhesive. In these processes the film and panel form a layered material with the film adhered to the shade over substantially the entire surface of the shade panel.

The film may also be adhered or attached to only a portion of the shade panel. For example, the film may be attached to the shade panel only at the edges of the shade panel and film. Alternately, the film may be attached to the shade panel only at selected contact points. By attaching the film only at selected points the film is loose from the shade panel over the remaining portion of the window covering creating air gaps or pockets that provide insulating areas.

Figure 4:
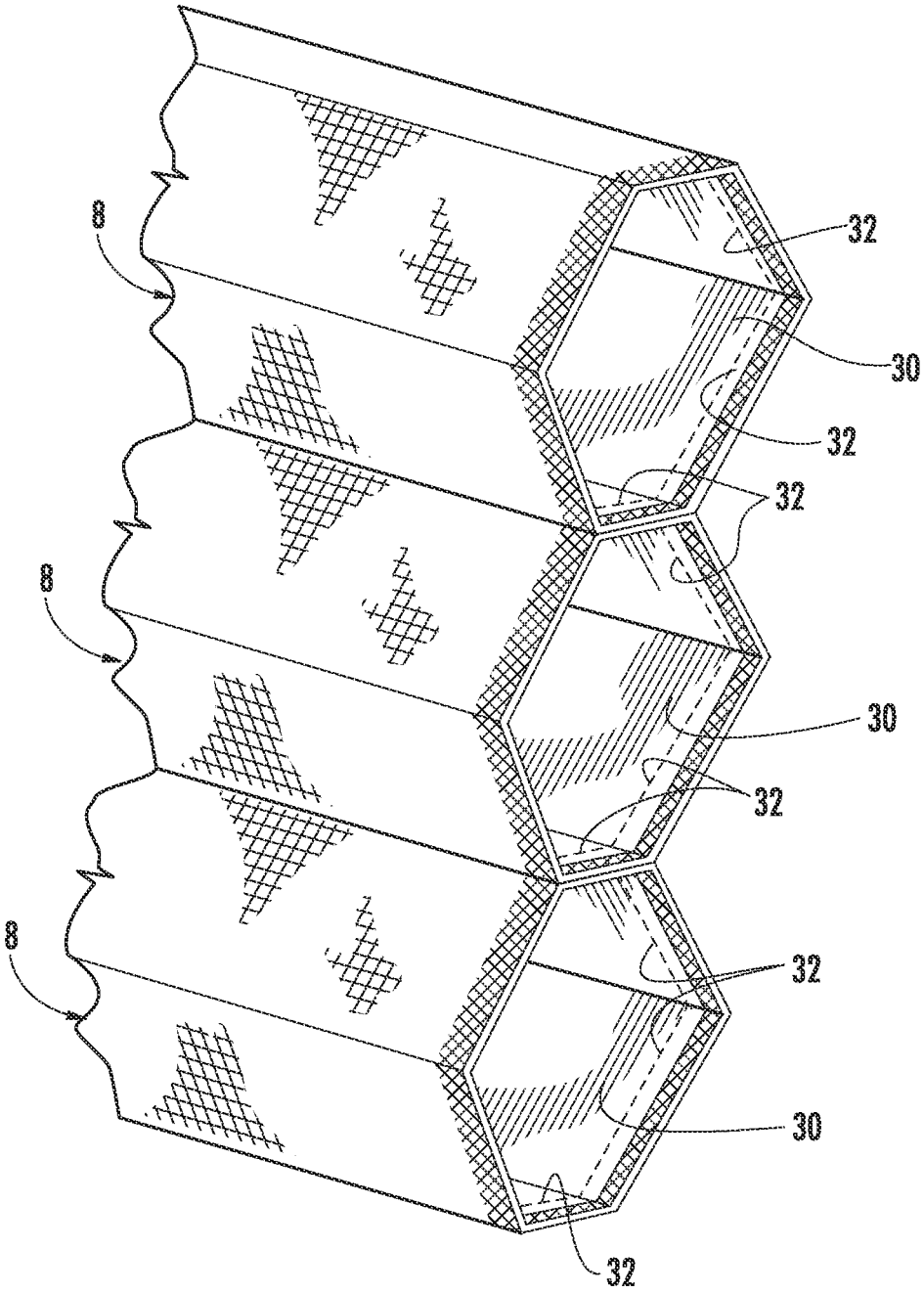
FIG. 4 is a partial perspective view of another embodiment of a shade panel.
Figure 5:
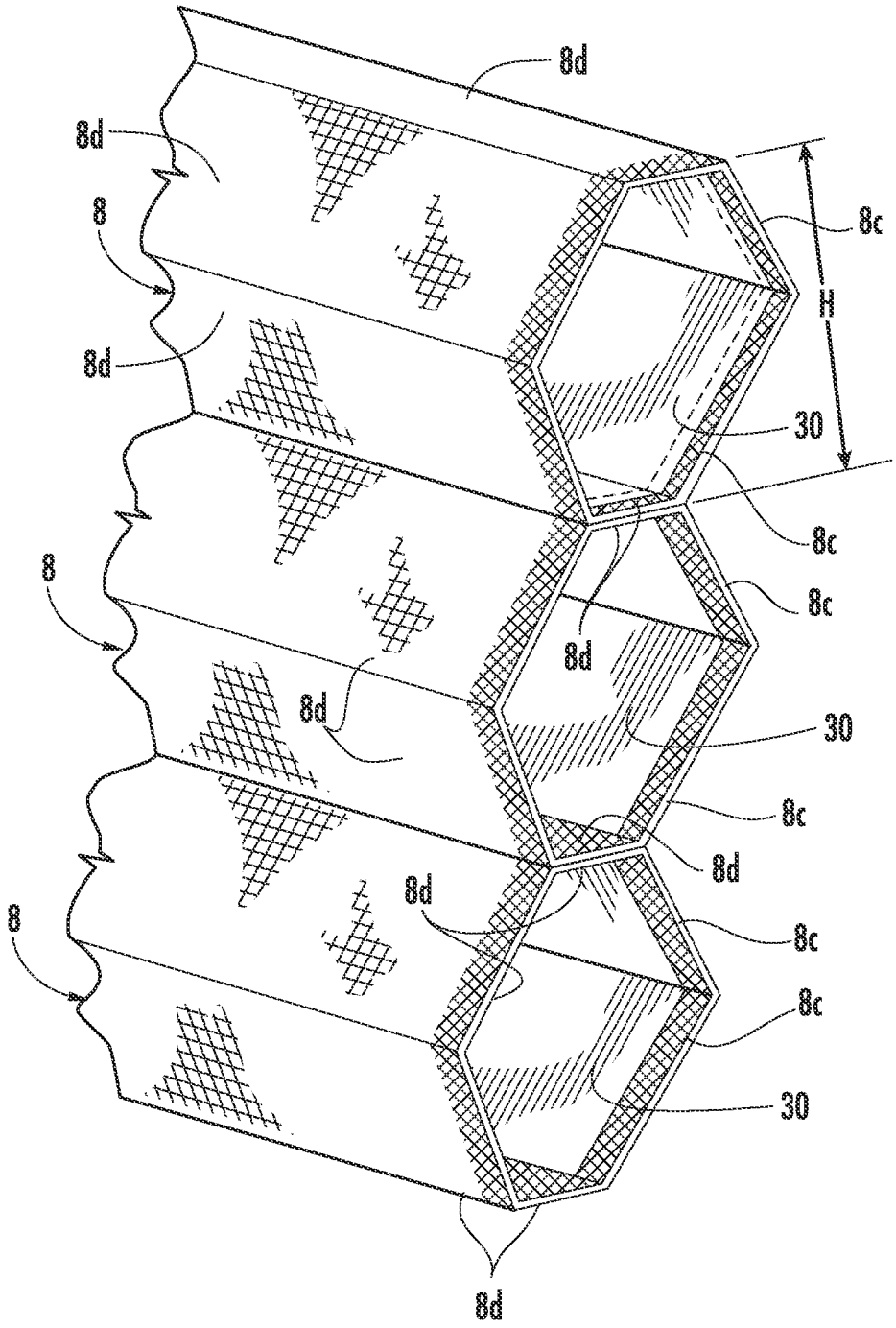
FIG. 5 is a partial perspective view of yet another embodiment of a shade panel.
Figure 6:
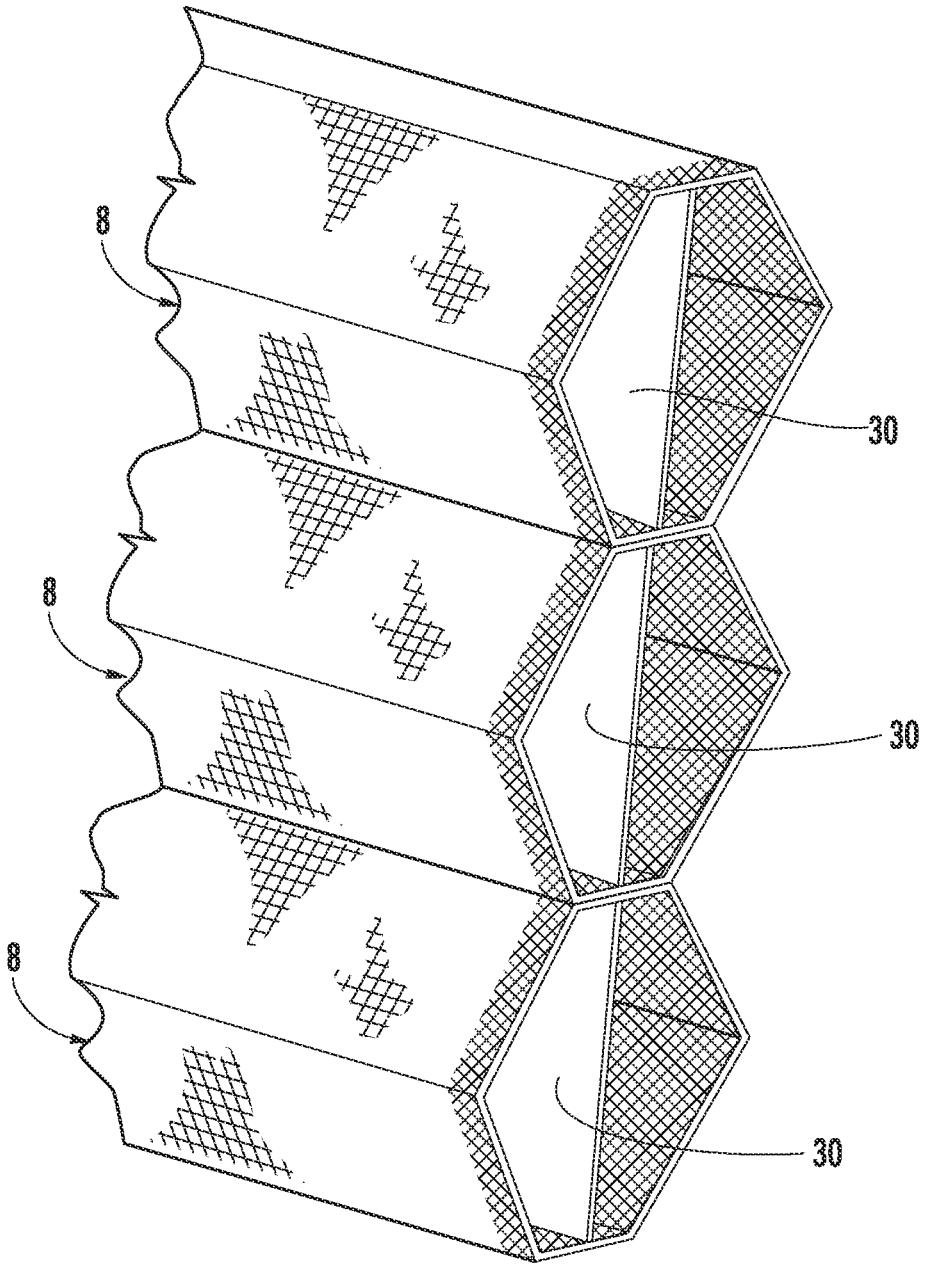
FIG. 6 is a partial perspective view of still another embodiment of a shade panel.
Figure 7:
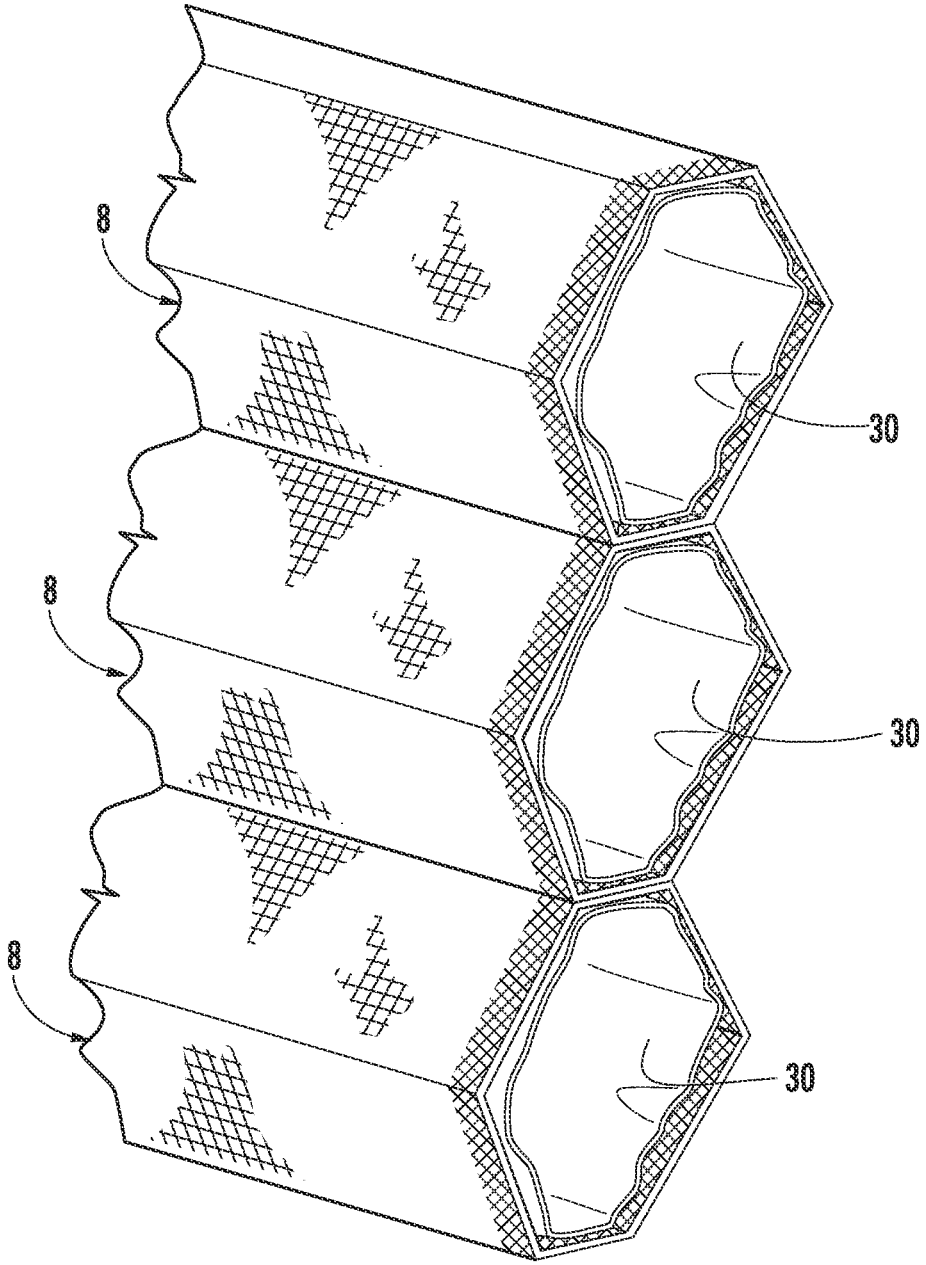
FIG. 7 is a partial perspective view of yet an embodiment of a shade panel.

The film layer 30 may be attached to the fabric of the cell using a variety of techniques. In the embodiment of FIG. 4, the film layer 30 is also shown sewn to the fabric of the cell 8 using stitching 32. The stitching 32 may be replaced by an adhesive where the adhesive is only applied to the edges of the film. In the embodiment of FIG. 7 the film 30 may be left unattached from the cell fabric such that it is loosely contained in the interior of cells 8 and is allowed to "float" in the cell. In this embodiment the film may be formed as a separate individual tubes that are positioned in each of cells 8 and that extend for substantially the length of the cells. The film 30 may be applied to all sides of the cell, as shown in FIG. 3, or the film 30 may be applied to only one side of the cell as shown in FIG. 5. As shown in FIG. 5, the film is applied to faces 8*c* but is not applied to faces 8*d*. The film may extend the entire height H of the cell 8 such that the film extends from the bottom of the cell to the top of the cell along a side of the cells. In this way a substantially continuous layer of film extends for the entire height of the shade panel 6. The film 30 may extend directly between the top and bottom of the cell rather than following the shape of the cell faces as shown in FIG. 6 such that the film extends from the bottom of the cell to the top of the cell and a continuous layer of film extends for the entire height of the shade panel 6. The film may also cover the open ends of the cells.

Figure 8:
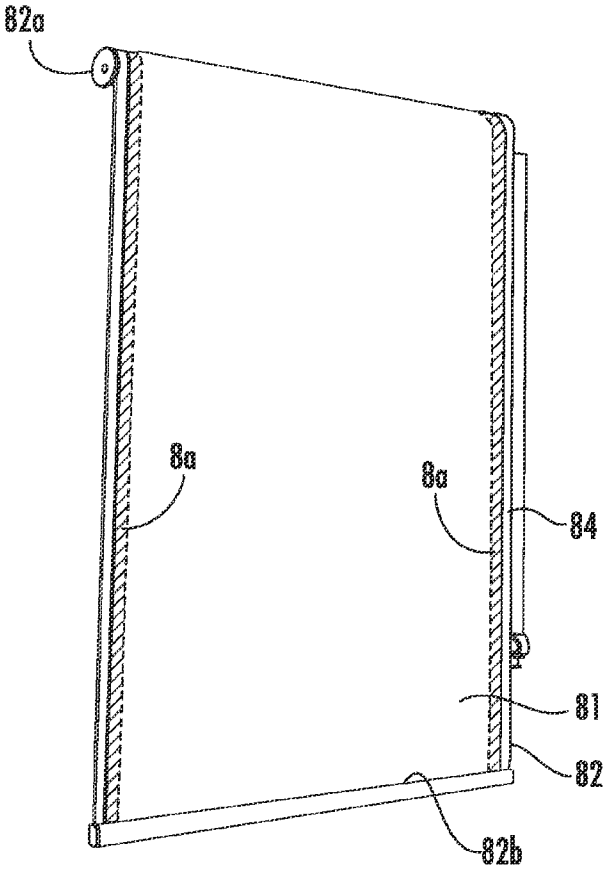
FIG. 8 is a perspective back view of an embodiment of a roller shade in accordance with the invention.

Referring to FIG. 8 an embodiment of a roller shade is shown comprising a flexible shade panel 82 formed in a roll 82*a* at its top end and having a free end 82*b* extending down from the roll. The free end can be grasped to wind or unwind the shade panel 82 to cover or uncover an architectural feature. The roll 82*a* is supported on a roller that includes a mechanism for winding and unwinding the shade on the roll and for holding the shade in a desired position as is known in the art. One side face 84 of panel 82 is covered with a layer of transparent film 81. The film 81 may be attached to the shade panel 82 only at the edges 80 of the shade panel and film such as shown in FIG. 8. The film layer 81 may be attached along its edges 80 by adhesive or stitching.

Figure 12:
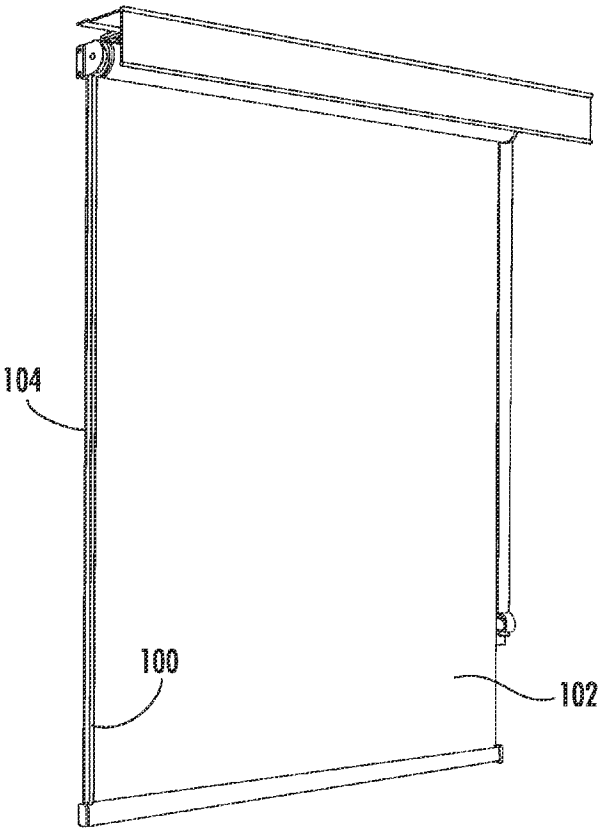

The film may be attached to the back side of the panel such that the film layer faces the window and is hidden from view when the window covering is mounted on a window. Referring to FIG. 12 the transparent film 100 may also be sandwiched between a first layer of panel 102 and a second layer of panel 104 such that the film layer 100 is hidden from view from both sides of the window covering. The transparent film may include any of the films previously disclosed herein and may be attached to the shade panel as previously described.

Figure 9:
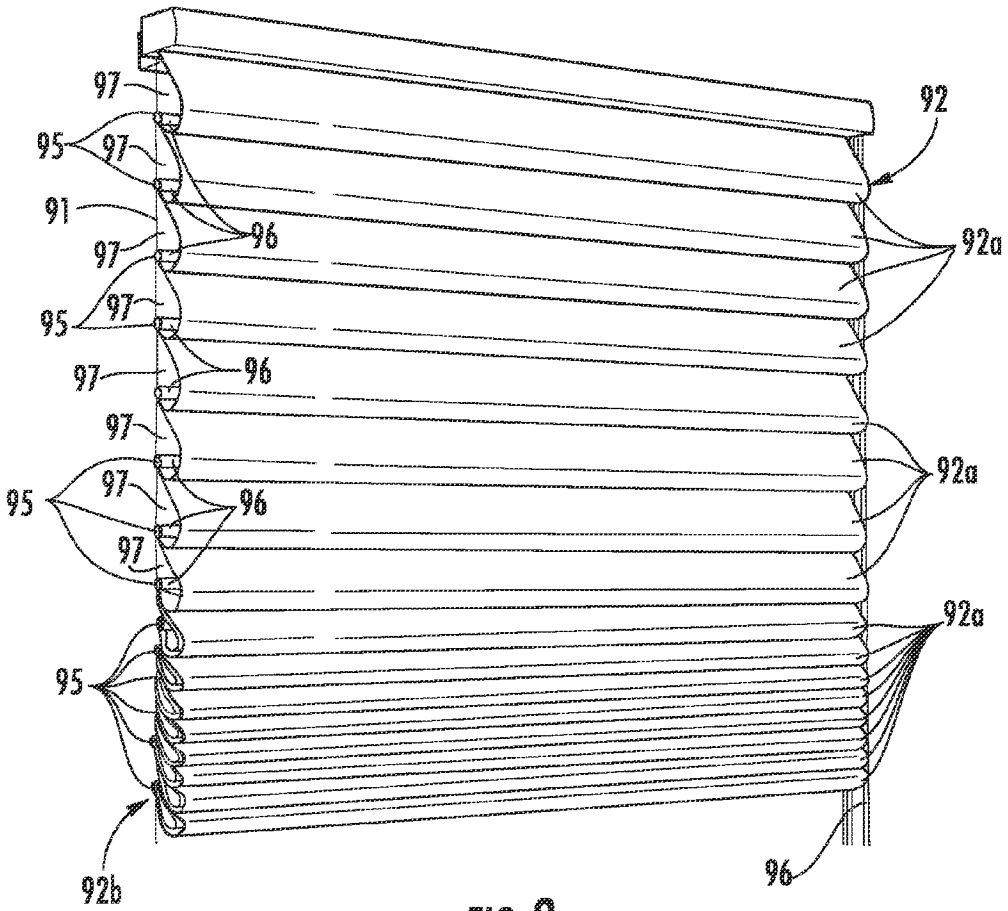
FIG. 9 is a perspective front view of an embodiment of a Roman shade in accordance with the invention.
Figure 13:
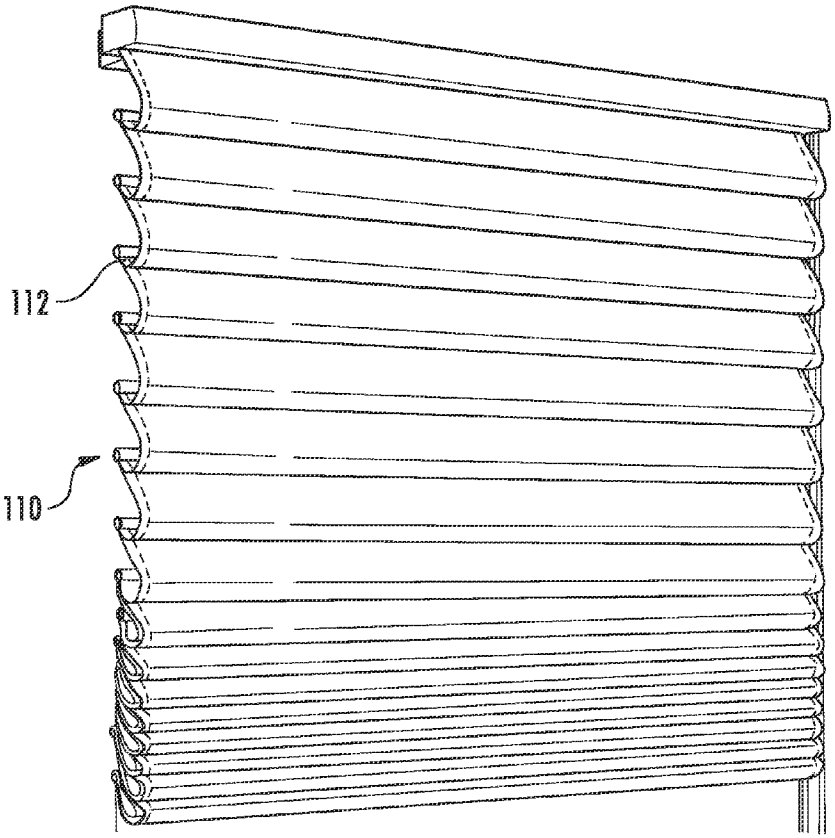

Referring to FIG. 9 an embodiment of a shade is shown comprising a flexible shade panel 92 formed as a Roman shade. A Roman shade includes a plurality of panel sections 92*a* connected to one another at pleats or fold lines 94 such that when the panel is raised, the shade panel 92 folds at lines 96. The sections 92*a* may be formed of one piece of material or they may be individual pieces of material connected at fold lines 96. The free end 92*b* of the panel 92 may be raised and lowered by lift cords 96 to cover or uncover an architectural feature as is known in the art. One side face 60*b* of shade panel 60 is covered with a layer of transparent film 68. The film 91 may be attached to the shade panel 92 only at selected contact points 85 as shown in FIG. 9. The film is connected to the panel 92 along the fold lines 95 such that pockets 97 are created between the film layer 91 and panel 92. The transparent film may include any of the films previously disclosed herein and may be attached to the shade panel as previously described. Referring to FIG. 13 an alternate embodiment of a Roman shade panel 110 is shown having a film layer 112 attached to the back of the panel 110 such that the film layer 112 follows the shape of the panel 110. The film layer 112 may be attached to the panel 110 using adhesive.

Figure 11:
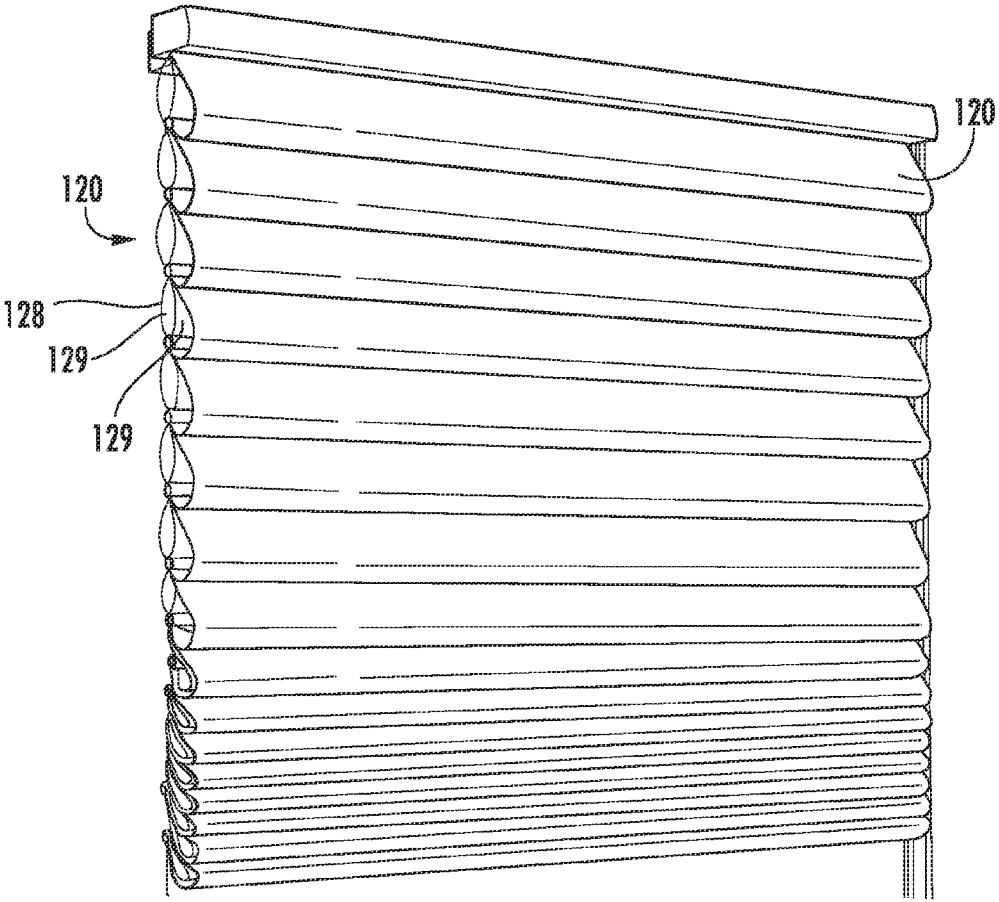
FIGS. 11 and 13 are perspective front views of other embodiments of a Roman shade in accordance with the invention.
Figure 10:
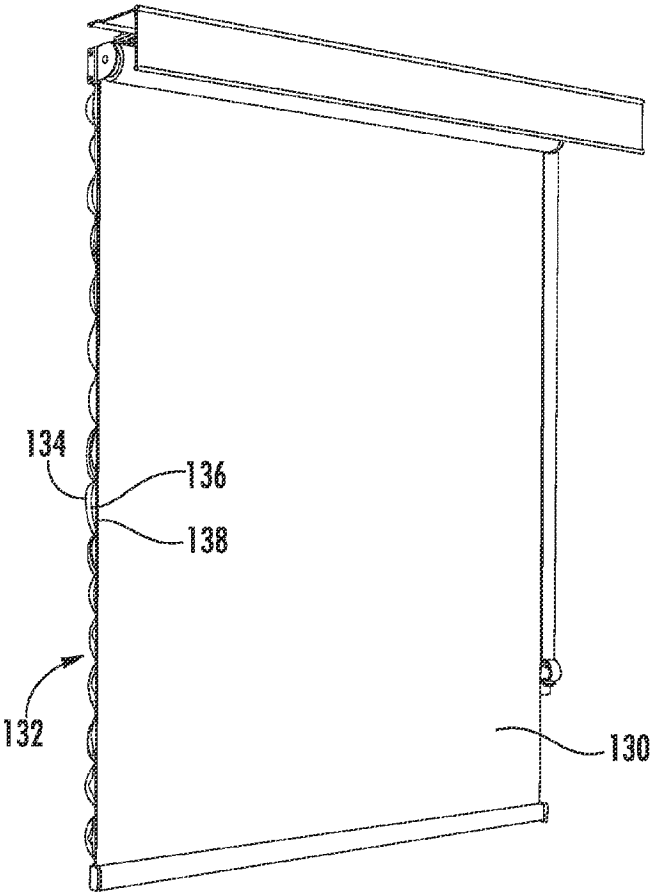
FIGS. 10 and 12 are perspective front views of other embodiments of a roller shade in accordance with the invention.

FIG. 11 shows another embodiment of a Roman shade panel 120. A film layer 122 is attached to the back side of the shade panel 120. The film layer 120 comprises a first ply 124 attached to the panel 120 at selected points. The first ply 124 is connected to the panel 120 along the fold lines 125. The film layer comprises a second ply 128 attached to the first ply along the fold lines such that an insulating pocket 129 is formed between the two plys. FIG. 12 shows another embodiment of a shade panel 130. A film layer 132 is attached to the back side of the shade panel 130. The film layer 132 comprises a first ply 134 attached to the panel 130 at selected points. The first ply 134 is connected to the panel 130 along lines that extend across the panel 130 such as by adhesive. The film layer 132 comprises a second ply 138 attached to the first ply 134 along the lines such that an insulating pocket 136 is formed between the two plys.

Specific embodiments of an invention are described herein. One of ordinary skill in the art will recognize that the invention has other applications in other environments. In fact, many embodiments and implementations are possible. The following claims are in no way intended to limit the scope of the invention to the specific embodiments described above.

The invention claimed is:

1. A window covering comprising:

a head rail;

a shade panel having a width, an upper edge and a lower edge, said shade panel comprising a plurality of cells made of a material, the plurality of cells comprising a plurality of faces extending between a top of each of the plurality of cells and a bottom of each of the plurality of cells, each of the plurality of faces having an inside surface that define an interior surface of each of the plurality of cells and the plurality of cells being connected to one another and arranged contiguously with one another;

a clear film located internally of said plurality of cells where the film extends for substantially the entire width of the plurality of cells, the film being made of a second material that is different than the material, and the film being connected to the inside surfaces of the plurality of faces of each of the plurality of cells such that the film substantially covers the interior surface of each of the plurality of cells.

2. The window covering of claim 1 wherein said shade panel is suspended from the head rail by at least one lift cord.

3. The window covering of claim 1 wherein the material comprises a woven fabric.

4. The window covering of claim 1 wherein the material comprises a non-woven fabric.

5. The window covering of claim 1 wherein each of said plurality of cells has a polygonal cross-sectional shape.

6. The window covering of claim 1 further including a bottom rail secured to the lower edge of the shade panel, a lift cord being secured to said bottom rail.

7. The window covering of claim 2 wherein said at least one lift cord is connected to a draw cord that is manipulated to raise and lower the shade panel.

8. The window covering of claim 1 wherein said film is a polyester clear film.

9. The window covering of claim 1 wherein said film is chemically adhered to the material.

10. The window covering of claim 1 wherein the film is a phase changing film.

11. The window covering of claim 1 wherein the film is attached to the material using chemical lamination.

12. The window covering of claim 1 wherein the film is attached to the material using adhesive.

13. The window covering of claim 1 wherein the film is sewn to the material.

14. The window covering of claim 1 wherein the shade panel comprises a plurality of fold lines, the film folding at the fold lines.

15. The window covering of claim 1 further comprising a second film connected to the film at the selected contact points.

* * * * *